US007641602B2

(12) United States Patent
Rogers et al.

(10) Patent No.: US 7,641,602 B2
(45) Date of Patent: Jan. 5, 2010

(54) WEIGHTLIFTING SYSTEM WITH POSITIONABLE HANDLES

(75) Inventors: Orley David Rogers, Sanford, MI (US); Kenneth Edward Staten, Clare, MI (US)

(73) Assignee: Rogers Athletic Company, Clare, MI (US)

( * ) Notice: Subject to any disclaimer, the term of this patent is extended or adjusted under 35 U.S.C. 154(b) by 365 days.

(21) Appl. No.: 11/326,112

(22) Filed: Jan. 5, 2006

(65) Prior Publication Data

US 2007/0155595 A1 Jul. 5, 2007

(51) Int. Cl.
*A63B 21/062* (2006.01)
*A63B 21/00* (2006.01)

(52) U.S. Cl. ..... 482/100; 482/135

(58) Field of Classification Search ..... *A63B 021/08*
See application file for complete search history.

(56) References Cited

U.S. PATENT DOCUMENTS 4,720,099 A * 1/1988 Carlson ..... 482/133
4,861,024 A 8/1989 Lee
4,949,951 A * 8/1990 Deola ..... 482/138
5,215,510 A 6/1993 Baran
5,643,152 A * 7/1997 Simonson ..... 482/100
5,669,859 A 9/1997 Liggett et al.
6,090,023 A * 7/2000 Liu ..... 482/140
6,132,343 A * 10/2000 Eze ..... 482/97
D439,943 S * 4/2001 Webber et al. ..... D21/694
D444,827 S 7/2001 Mobley
6,592,500 B1 * 7/2003 McBride et al. ..... 482/140
6,605,023 B1 8/2003 Mobley
6,623,407 B2 9/2003 Novak et al.
6,623,409 B1 9/2003 Abelbeck
6,669,607 B2 12/2003 Slawinski et al.
6,905,446 B2 * 6/2005 Greenland ..... 482/100
7,094,185 B2 * 8/2006 Greenland ..... 482/100
7,322,906 B2 * 1/2008 Webber ..... 482/100
7,361,125 B2 * 4/2008 Webber et al. ..... 482/95
7,384,381 B2 * 6/2008 Webber et al. ..... 482/100

OTHER PUBLICATIONS

"Splined." Dictionary.com Unabridged (v 1.1). Random House, Inc. Dec. 13, 2007.*

* cited by examiner

*Primary Examiner*—Fenn C Mathew
(74) *Attorney, Agent, or Firm*—Carlson, Gaskey & Olds

(57) ABSTRACT

A weightlifting system includes a weight arm system having a handle which may be mounted in one of a multitude of clocked positions. A handle engagement member extends radially from the handle adjacent the end section and includes a multitude of radially extending engagement male members to take the shape of a gear or multi-pointed star. The multitude of radially extending engagement members of the handle engagement member corresponds with a multitude of radially extending engagement members which defines an arm engagement member on the weight arm about an opening. The handle engagement member is the opposite of the handle engagement member such that the handle engagement member is received therein at a multitude of clocked positions as defined by the multitude of radially extending engagement handle members and the multitude of radially extending engagement arm members. The handle is clocked to a desired position relative the weight arm and an internal threaded section of a weight horn or knob is threaded to a threaded section of the handle to axially retain the handle within the weight arm.

16 Claims, 5 Drawing Sheets

WEIGHTLIFTING SYSTEM WITH POSITIONABLE HANDLES

BACKGROUND OF THE INVENTION

The present invention relates to weightlifting equipment, and more particularly to handle attachment arrangement.

Weightlifters perform various exercises for the purpose of developing particular muscles throughout the body. These exercises can be performed through the use of free weights, such as barbells, or with machines. Many weightlifters prefer free weights because free weights permit the lifter to perform the exercises in a natural motion while utilizing pure body leverage in performing the exercise. This facilitates isolation of particular muscle groups and simulates actual athletic sports motions. Oftentimes it is desirable to simulate the range of motion of free weights within a controlled environment of a machine. Most machines however are limited to a two-dimensional plane of movement. The machines are often further limited as the handles or grips are typically fixed in a specific orientation. Although effective, numerous machines are required as each machine is typically dedicated to only a few or a single exercise.

Machines are also relatively limited in the amount of weight which is contained within the machines stack of plates. As such, machines are undesirable for power lifting and for the training of powerful weightlifters who may find the stack of plates to be less than their capabilities.

Accordingly, it is desirable to provide a weightlifting system that will support a significant amount of weight, yet provide various handle orientations to specifically tailor an exercise to a specific athlete or specific exercise.

SUMMARY OF THE INVENTION

A weightlifting system according to the present invention includes various arm systems such as an incline arm system or a decline arm system. Each arm system includes a handle which may be mounted in one of a multitude of clocked positions.

The handle includes an attachment member with a threaded section which extends from an end section of the handle. A handle engagement member extends radially from the handle adjacent the end section and includes a multitude of radially extending engagement members which take the shape of a gear or multi-pointed star.

The multitude of radially extending engagement members of the handle engagement member corresponds with a multitude of radially extending engagement members which defines an arm engagement member on the weight arm about an opening. The arm engagement member is the opposite of the handle engagement member such that the handle engagement member is received therein at a multitude of clocked positions as defined by the multitude of radially extending engagement handle members and the multitude of radially extending engagement arm members.

In use, the attachment member and the end section of the handle are passed through the arm opening such that the threaded section is accessible from a side opposite from which the handle has been inserted. The handle is clocked to a desired position relative the weight arm and an internal threaded section of the weight horn is threaded to the threaded section of the handle to axially retain the handle to the weight arm.

Alternatively, a threaded knob is utilized to axially retain the handle on other arm systems which locate the weight horn a distance from the handle.

Interaction between a tubular reinforcement within the weight arm and the handle supports the lever force applied through the handle. The threaded sections need only provide an axial force to sandwich the weight arm between the handle and the weight horn or knob such that the handle engagement member and the arm engagement member maintains the clocked position of the handle relative the weight arm. An exceedingly strong attachment is thereby provided to resist significant force yet provides for the handle to be readily repositioned.

The present invention therefore desirable to provide a weightlifting system that will support a significant amount of weight, yet provide various handle orientations to specifically tailor an exercise to a specific athlete or specific exercise.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1A:
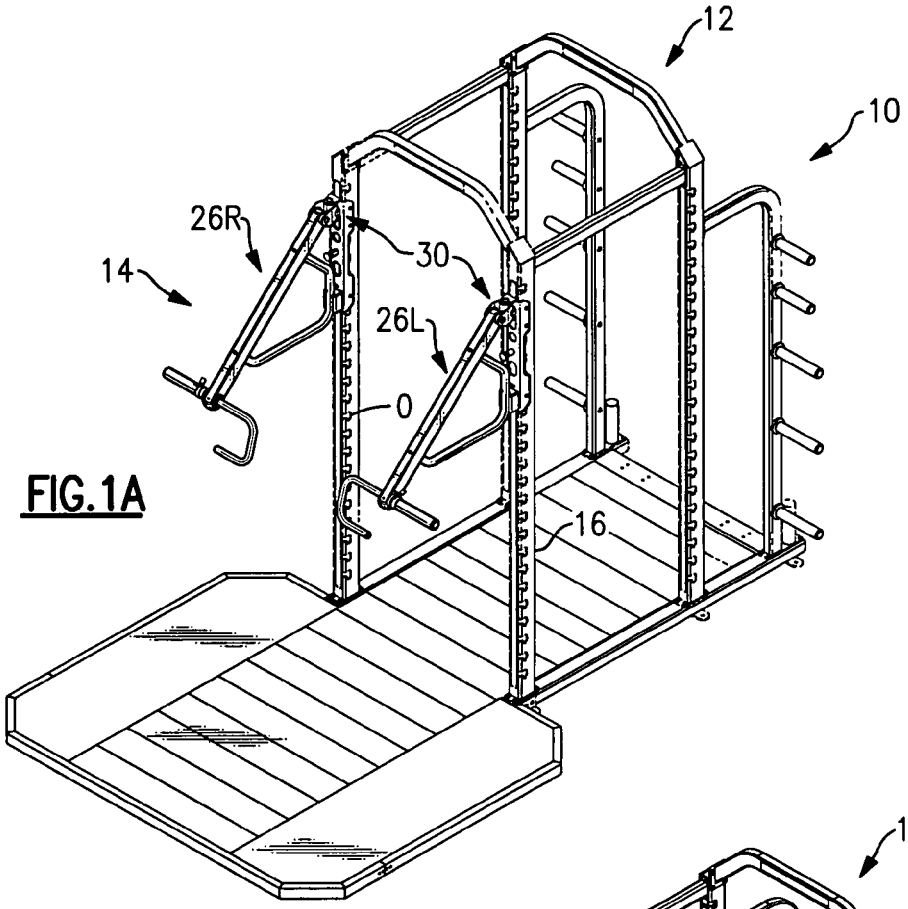
FIG. 1A is a perspective view of a weightlifting system with an incline arm system attached thereto.
Figure 1B:
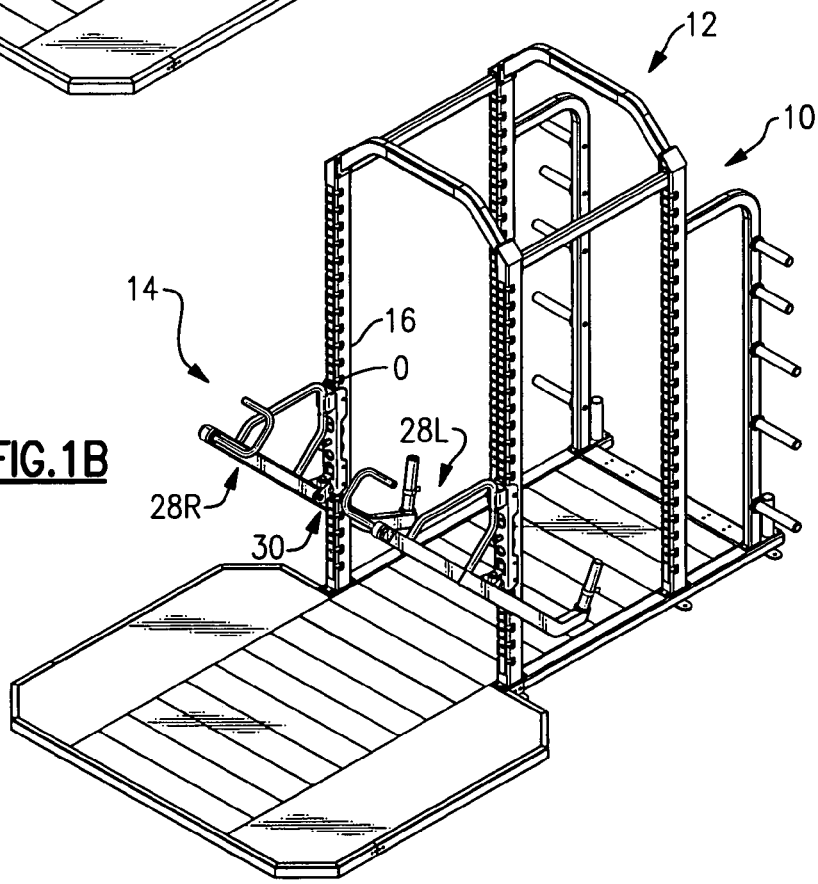
FIG. 1B is a weightlifting system with a decline arm system attached thereto.

FIGS. 1A and 1B illustrates a perspective view of a weightlifting system 10 which includes a weight bar frame rack 12 for mounting various weight arm systems 14. The frame rack 12 includes a multitude of openings O along an upright frame member 16 which receives the weight arm system 14 which may be located at various positions along the frame member 16. Each opening O is separated from the next by approximately four inches to provide significant incremental adjustment, however, any separation will be usable with the present invention.

Figure 2:
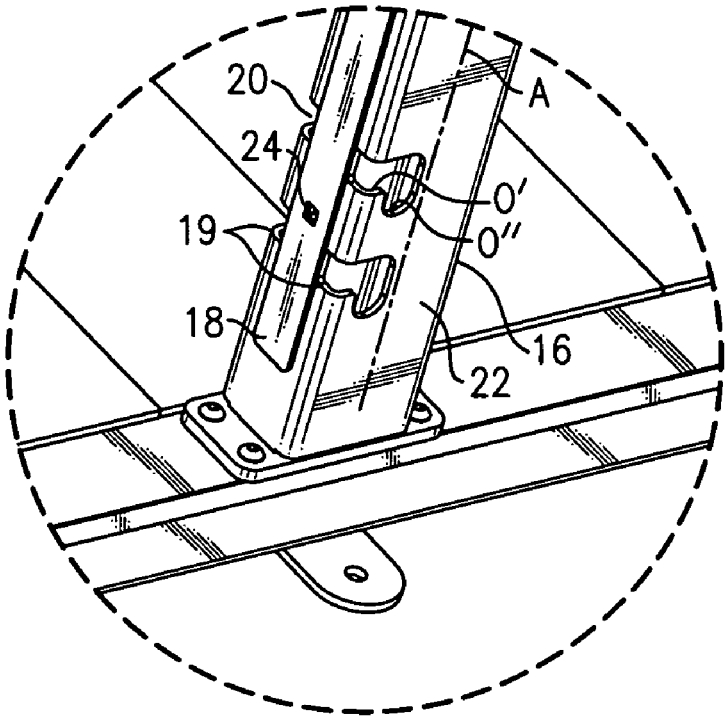
FIG. 2 is an expanded view of the weightlifting frame rack of FIGS. 1A and 1B.
Figure 3:
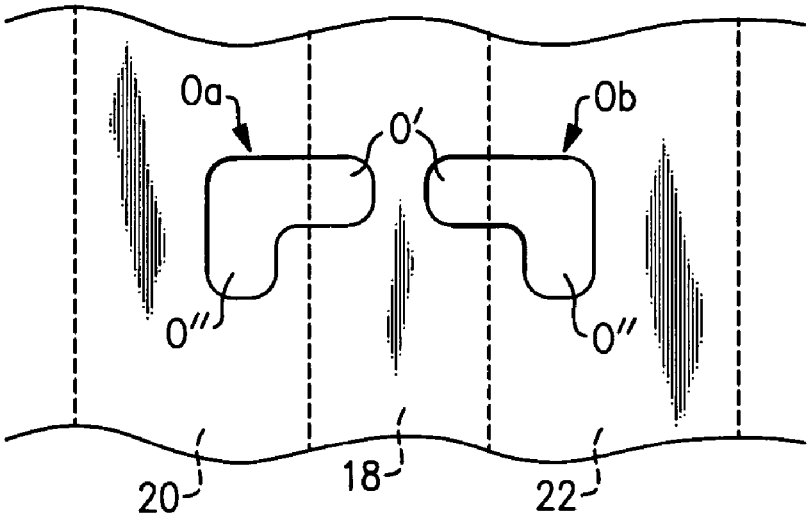
FIG. 3 is a schematic view of an opening in a weightlifting system frame rack upright.

Referring to FIG. 2, each upright frame member 16 defines a longitudinal axis A which extends vertically relative to the ground. The upright frame member 16 is generally rectilinear in shape and is preferably manufactured of tubing which is rectangular in cross-section. The upright frame member 16 includes a front face 18 and a first and second side face 20, 22. Each opening O spans the intersection of the front face 18 and one of the side faces 20, 22. In other words, each opening O cuts through the corner of the upright frame member 16. Each opening O includes a first opening portion O' in the front face 18 generally transverse to the longitudinal axis A and a second opening portion O" through the respective side face 20, 22 generally parallel to the longitudinal axis A. That is, the opening portions O' and O" are generally perpendicular if laid flat (FIG. 3). Preferably, each opening O includes relatively large corner radiuses.

The openings O are arranged in horizontally opposed pairs of openings O*a*, O*b* perpendicular to the longitudinal axis A (best seen in FIG. 3). That is, each pair of openings O includes a first opening O*a* located through the front face 18 and the first side face 20 and a second opening O*b* located through the front face 18 and the second side face 22 such that the openings O*a*, O*b* are aligned when viewed from one of the side faces 20, 22.

A lock opening 24 is located through the front face 18 between each vertically separated pair of openings O*a*, O*b*. Each lock opening 24 is displaced parallel to the longitudinal axis A and is generally square in shape. It should be understood that other shapes will also be readily usable with the present invention. Preferably, the lock opening 24 is longitudinally staggered above each pair of openings O*a*, O*b*. For further understanding of other aspects of the rack system, attachment thereto and associated components thereof, attention is directed to U.S. patent application Ser. No. 11/326,099 filed Jan. 5, 2006 and entitled: WEIGHTLIFTING SUPPORT ASSEMBLY which is assigned to the assignee of the instant invention and which is hereby incorporated herein in its entirety.

Figure 4A:
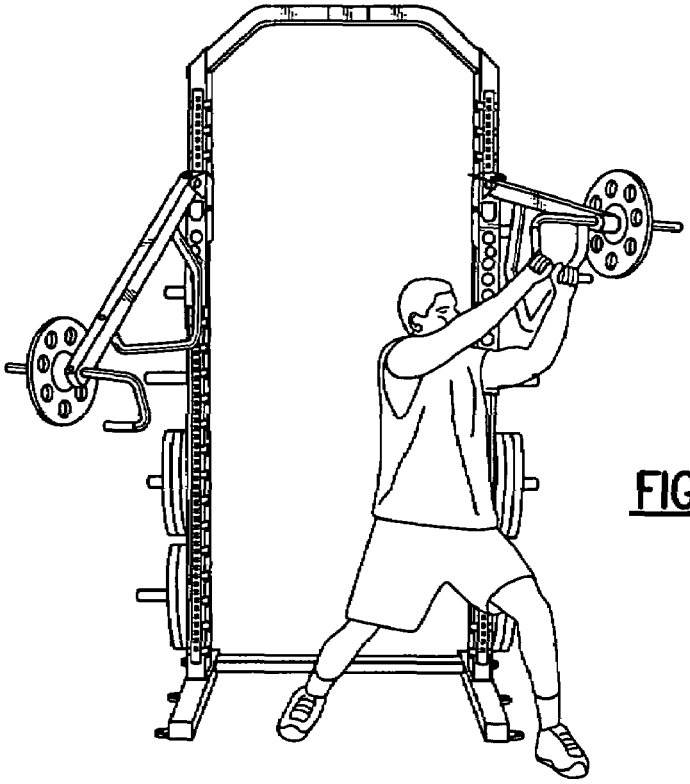
FIG. 4A is an example of the incline arm system in use.
Figure 4B:
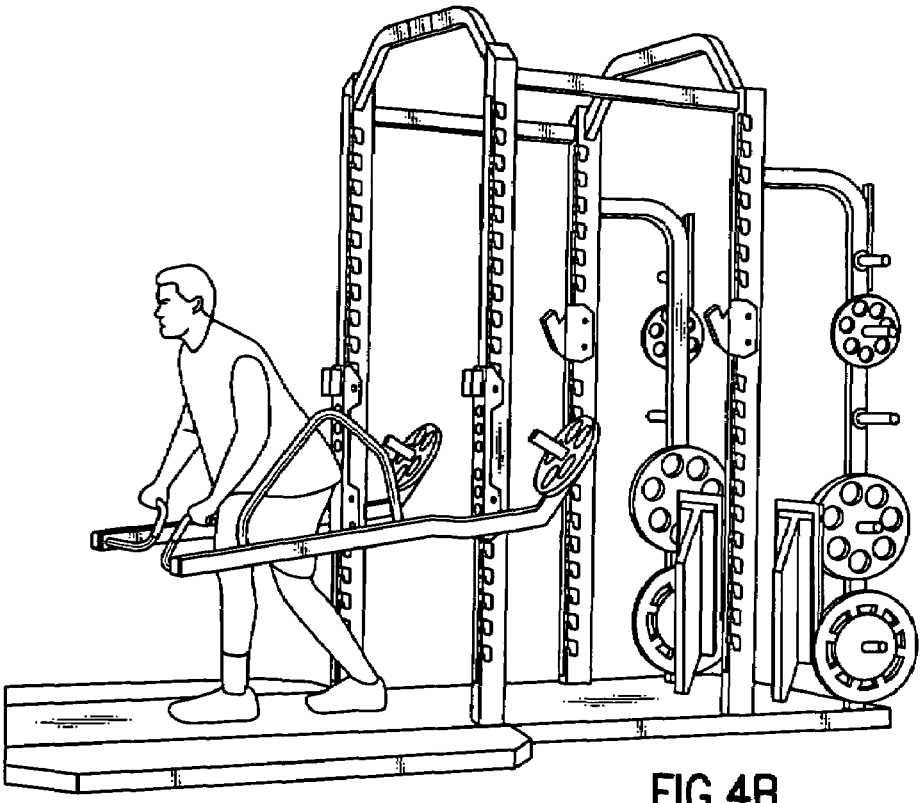
FIG. 4B is an example view of the decline arm system in use.

The weight arm system 14 may include various arm systems such as an incline arm system 26 (FIG. 1A) or a decline arm system 28 (FIG. 1B). The incline arm system 26 typically permits exercises which develop legs, hips, chest shoulder and arm muscles amongst (FIG. 4A) while the decline arm system 28 typically permits core exercises (FIG. 4B). It should be understood that such exercises are exemplarily only and that other exercises may be performed—all of which are beneficially improved through the omni directional movement facilitated by the omni directional pivot system 30 through which the weight arm system 14 are mounted. The omni directional pivot system 30 combines the improved neuromuscular development typical of free weights exercises within the controlled environment typical of a machine. It should be understood that although a particular frame arrangement is illustrated in the disclosed embodiment, other arrangements will be usable with the present invention.

Figure 5:
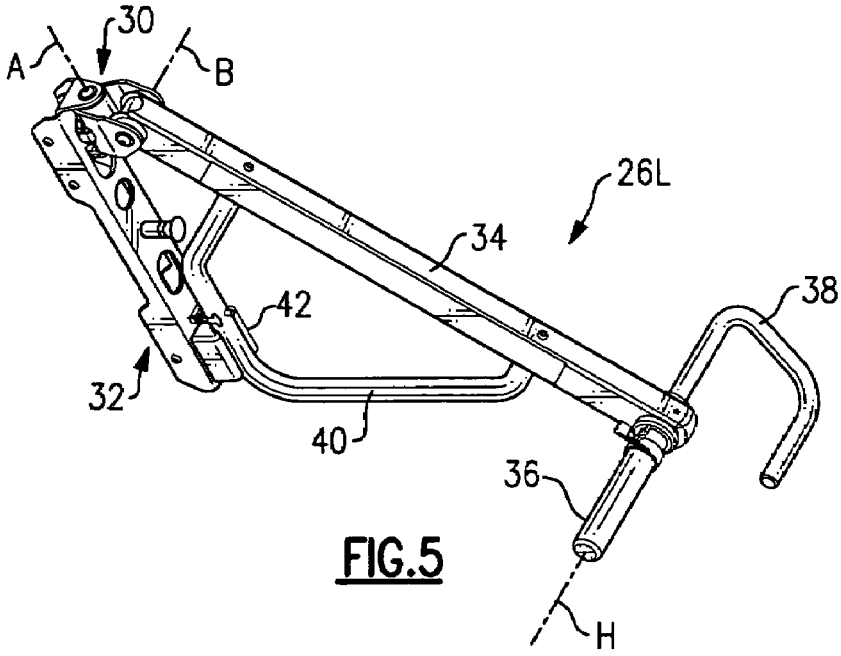
FIG. 5A is a perspective view of a left hand incline arm system.

Referring to FIG. 5, a left hand incline arm system 26L generally includes a bracket assembly 32, a weight arm 34, a weight horn 36, a handle 38 and a stop 40. The weight arm 34 may be of various configuration depending upon the desired exercises which are to be performed therewith. Preferably, the handle 38 is mounted to the weight arm 34 along a common axis H by attaching the weight horn 36 to the handle 38 with the weight arm 34 trapped therebetween. Preferably, the handle 38 may be selectively mounted at a multitude of clocked positions about the axis H.

Figure 6:
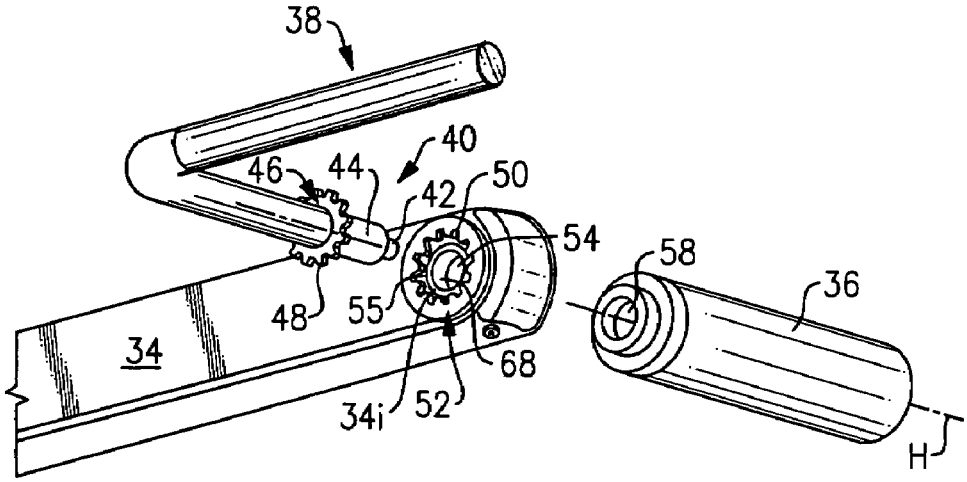
FIG. 6 is an exploded view of a handle assembly of the incline arm system.

Referring to FIG. 6, the handle 38 includes an attachment section 40 with a threaded section 42 along an end section 44. The end section 44 of the handle 38 is preferably received within the weight horn 36 in a telescoping relationship.

A handle engagement member 46 extends radially from the handle 38 adjacent the end section 44. The handle engagement member 46 defines a multitude of male members 48. Preferably, the handle engagement member 46 takes the shape of a gear or multi-pointed star mounted about the attachment section 40.

Figure 7:
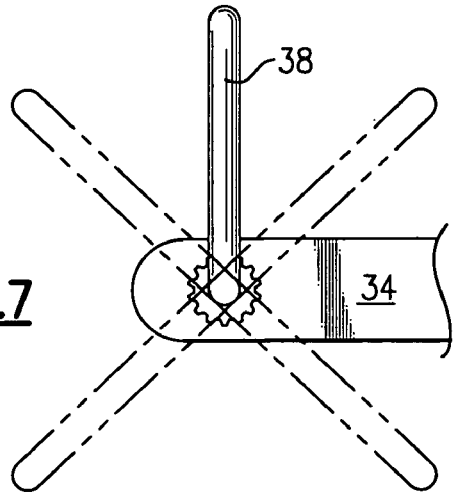
FIG. 7 is a schematic view of the handle assembly in a multiple of positions.

The multitude of male members 48 of the handle engagement member 46 corresponds with a multitude of female members 50 which defines an arm engagement member 52 formed on the weight arm 34 about an opening 54. The handle engagement member 46 is the opposite of the arm engagement member 52 such that the handle engagement member 46 may be received therein at a multitude of clocked positions as defined by the multitude of male members 48 and the multitude of female members 50. In other words, the number of multitude of male and female members 48, 50 fit in a male and female relationship to define the number of clocked positions (FIG. 7).

The arm engagement member 52 is preferably a plate attached to the weight arm 34 about the opening 54 preferably through welding or the like to define a recessed receipt area 55 to receive the handle engagement member 46 adjacent an inner side 34*i* of the weight arm 34. It should be understood that other openings may combine or individualize these features while still providing receipt at a multitude of clocked positions.

In use, the end section 44 of the handle 38 is passed through the opening 54 such that the threaded section 42 is accessible from the side of the arm 34*o* opposite from which the handle 38 has been inserted. The handle 38 is clocked to a desired position relative the weight arm 34 (FIG. 7) and an internal threaded section 58 of the weight horn 36 is threaded to the threaded section 42 to axially retain the handle 34 to the weight arm 34.

Preferably, a tubular reinforcement 68 is located within the weight arm 34 to receive the end section 44 of the handle 38. Notably, interaction between the tubular reinforcement 68 and the handle supports the force applied through the handle 38 as the threaded sections 42, 58 need only provide an axial force along axis H to sandwich the weight arm 34 between the handle 38 and the weight horn 36 while the handle engagement member 46 and the arm engagement member 52 maintain the clocked position of the handle 38 relative the weight arm 34. An exceedingly strong attachment is thereby provided to resist significant force yet provide for the handle to be readily repositioned.

Figure 8:
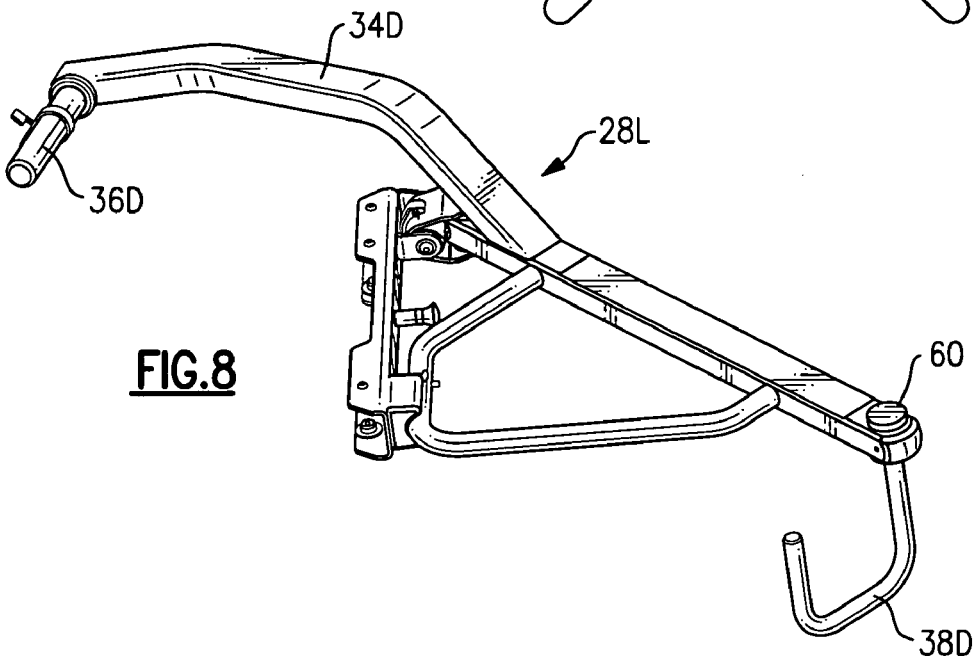
FIG. 8 is a perspective view of a left hand decline arm system.

Referring to FIG. 8, a left hand decline arm system 28L of the decline arm system 28 (FIG. 1B) includes a weight arm 34D which locates the weight horn 36D and the handle 38D at generally opposite ends as compared to the incline arm system 26 which locates the weight horn 36 and handle 38 generally toward one end. It should be understood that although left arms are disclosed in the illustrated embodiment right arms (FIGS. 1A, 1B, 2A, 2B) are likewise constructed.

Figure 9:
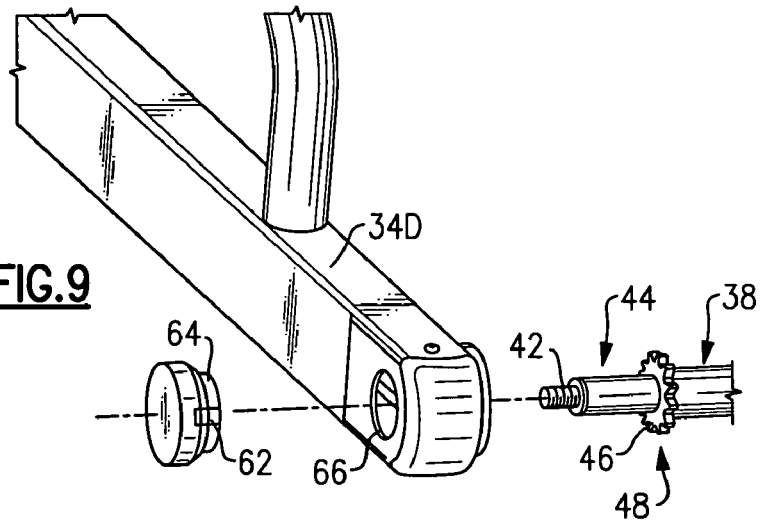
FIG. 9 is an exploded view of the handle assembly for the monster decline arm system illustrated in FIG. 8.

Since the weight horn 36D and the handle 38D are located at generally opposite ends, a knob 60 is utilized to retain the handle 38D to the weight arm 34D. Preferably, the knob 60 includes an internal thread 62 and a reduced diameter portion 64 which fits within a complementary opening 66 (FIG. 9) formed in the weight arm 34D. As described above, the handle 38 may be clocked to a desired position simply by unthreading the knob 60 and rotating the handle engagement member 46 relative the arm engagement member 52. Notably, neither the handle 38 nor the weight horn 36 (FIG. 6) need be completely removed. The handle 38 or the weight horn 36 (FIG. 6) need only be loosened to the point that the handle engagement member 46 may be rotationally disengaged from the arm engagement member 52 to permit relative rotation (FIG. 7). Once clocked to the desired positioned, the knob 60 or the weight horn 36 (FIG. 6) is simply tightened down to engagement.

It should be understood that relative positional terms such as "forward," "aft," "upper," "lower," "above," "below," and the like are with reference to the normal operational attitude and should not be considered otherwise limiting.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A weightlifting weight arm system comprising:

a weight arm which defines an opening therethrough along an axis with a first engagement member defined at least partially around said opening end a pivot displaced from sad first engagement member, said pivot operable to permit movement of said weight arm; and a handle which comprises an attachment section and a second engagement member engageable with said first engagement member to position said handle at one of a multitude of clocked positions around said axis; and a knob engageable with said attachment section to axially retain said handle along said axis at said one of a multitude of docked positions.

2. The system as recited in claim 1, wherein said attachment section comprises a threaded section.

3. The system as recited in claim 1, wherein said second engagement member radially extends from said handle.

4. The system as recited in claim 1, wherein said pivot comprises an omni-directional pivot.

5. The system as recited in claim 1, wherein said pivot is at least partially defined by a bracket operable to mount said weight arm to a frame rack member.

6. A weightlifting weight arm system comprising:

a weight arm which defines a first engagement member about an axis aid a pivot displaced from said first engagement member, said pivot operable to permit movement of said weight arm; aid a handle which comprises a second engagement member engageable with said first engagement member to position said handle at one of a multitude of docked positions around said axis, said first engagement member comprises a gear shaped opening and said second engagement member comprises a gear shaped member which fits within said opening.

7. The system as recited in claim 6, wherein said pivot comprises an omni-directional pivot.

8. The system as recited in claim 6, wherein said pivot is at least partially defined by a bracket operable to mount said weight arm to a frame rack member.

9. A weightlifting weight arm system comprising:

a weight arm which defines an opening therethrough along an axis with a first engagement member defined at least partially around said opening and a pivot displaced from sad first engagement member, said pivot operable to permit movement of said weight arm;

a handle which comprises an attachment section and a second engagement member engageable with said first engagement member to position said handle at one of a multitude of docked positions around said axis; and a weight horn engageable with said attachment member to axially retain said handle along said axis at said one of a multitude of docked positions.

10. The system as recited in claim 9, wherein said attachment section comprises a threaded section.

11. The system as recited in dam 9, wherein said weight horn is a generally tubular member.

12. A weightlifting weight arm system comprising:

a weight arm which defines a first engagement member about an axis and a pivot displaced from said first engagement member, said pivot operable to permit movement of said weight arm; and a handle which comprises a second engagement member engageable with said first engagement member to position said handle at one of a multitude of clocked positions around said axis, said handle comprises an attachment section along said axis, said attachment section comprises a threaded section.

13. The system as recited in claim 12, further comprising a knob engageable with said threaded section opposite said weight arm.

14. The system as recited in claim 12, further comprising a weight horn engageable with said threaded section opposite said weight arm.

15. A weightlifting weight arm system comprising:

a weight arm which defines a first engagement member about an axis and a pivot displaced from said first engagement member, said pivot operable to permit movement of said weight arm; and a handle which comprises a second engagement member engageable with said first engagement member to postion said handle at one of a multitude of docked positions around said axis, wherein said first engagement member comprises a star shaped opening and said second engagement member comprises a star shaped member which fits within said opening.

16. A weightlifting weight arm system comprising:

a weight arm which defines a first engagement member about an axis and a pivot displaced from said first engagement member, said pivot operable to permit movement of said weight arm; and a handle which comprises a second engagement member engageable with said first engagement member to position said handle at one of a multitude of clocked positions around said axis, wherein said first engagement member comprises a multitude of radial extending openings and said second engagement member comprises a multitude of radially extending male member which correspond with said multitude of radial extending openings.

* * * * *

UNITED STATES PATENT AND TRADEMARK OFFICE

CERTIFICATE OF CORRECTION

PATENT NO. : 7,641,602 B2
APPLICATION NO. : 11/326112
DATED : January 5, 2010
INVENTOR(S) : Rogers et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 502 days.

Signed and Sealed this

Twenty-first Day of December, 2010

David J. Kappos

David J. Kappos
*Director of the United States Patent and Trademark Office*